US011332901B1

(12) United States Patent
Eckerman

(10) Patent No.: US 11,332,901 B1
(45) Date of Patent: May 17, 2022

(54) ADJUSTABLE STEP

(71) Applicant: David Eckerman, Wichita, KS (US)

(72) Inventor: David Eckerman, Wichita, KS (US)

( * ) Notice: Subject to any disclaimer, the term of this patent is extended or adjusted under 35 U.S.C. 154(b) by 245 days.

(21) Appl. No.: 16/885,563

(22) Filed: May 28, 2020

(51) Int. Cl.
*E06C 9/04* (2006.01)
*A63B 27/00* (2006.01)
*E02B 3/20* (2006.01)

(52) U.S. Cl.
CPC ..... *E02B 3/20* (2013.01); *A63B 27/00* (2013.01); *E06C 9/04* (2013.01)

(58) Field of Classification Search
CPC ..... E02B 3/20; E06C 9/04; E06C 9/06; A63B 27/00; A63B 27/02; A63B 27/04
USPC ..... 182/92, 133–136
See application file for complete search history.

(56) References Cited

U.S. PATENT DOCUMENTS 2,437,012 A * 3/1948 White ..... E06C 9/04 182/187
3,561,563 A * 2/1971 Harsh ..... E06C 9/04 D30/158
4,754,841 A * 7/1988 Koffski ..... E06C 9/04 248/217.1
4,969,620 A * 11/1990 Plummer ..... E06C 1/381 248/246
D342,200 S * 12/1993 Hass ..... E06C 9/04 D8/71
5,285,868 A * 2/1994 Amacker ..... A01M 31/02 182/187
5,620,059 A * 4/1997 Crispeno ..... E06C 5/00 182/127
5,799,961 A * 9/1998 Schmeets ..... E06C 5/00 280/169
5,857,542 A * 1/1999 Mason ..... E06C 7/08 182/92
6,247,553 B1 * 6/2001 Jones ..... E06C 9/04 256/DIG. 5
6,752,243 B1 * 6/2004 Terzini ..... E04G 5/062 182/189
6,932,021 B1 8/2005 Martini
7,182,035 B1 2/2007 Palmer
7,527,015 B1 5/2009 Peter
7,552,798 B2 * 6/2009 Swierski ..... A63B 27/04 182/134
8,821,067 B1 9/2014 Anderson
9,114,856 B2 8/2015 Hannan et al.
(Continued)

OTHER PUBLICATIONS

Stabil-Step Jack, 4⅝"-7¾". Product Listing [online], © CWI, Inc. 2020 [retrieved on Nov. 13, 2019]. Retrieved from the Internet: <URL: https://www.overtons.com/stabil-step-jack-4-58quot%3B-7-34quot%3B-30983.html?cgid=steps-handrails#start=13&cgid=anchoring-docking%2Fdock-accessories%2Fsteps-handrails>.
(Continued)

*Primary Examiner* — Frederick L Lagman
(74) *Attorney, Agent, or Firm* — Cramer Patent & Design, PLLC; Aaron R. Cramer

(57) ABSTRACT

An adjustable step includes a planar surface having an acute angular bend at an off-center portion of the planar surface dividing the device into a first section and a second section. The first section has anti-slip surface disposed upon a topside face. The second section has a rectangular cutout portion that transects an edge of the second section. The step is configured to removably secure about a dock post and remain in position when pressure is applied to said first section.

20 Claims, 5 Drawing Sheets

(56) References Cited

U.S. PATENT DOCUMENTS

| | | | | |
|---|---|---|---|---|
| 2003/0209386 | A1* | 11/2003 | Lackey | E04G 23/08 182/92 |
| 2020/0080327 | A1* | 3/2020 | Burrow | A63B 27/00 |

OTHER PUBLICATIONS

Boat Trailer Step. Product Listing [online]. © 2000-2020 Home Depot Product Authority, LLC [retrieved on Nov. 13, 2019]. Retrieved from the Internet: <URL: https://www.homedepot.com/p/HitchMate-Boat-Trailer-Step-4036/203517794>.

MaxxHaul 70089 Steel Trailer Step by MAXXHAUL. Product Listing [online]. © 2008-2020, Amazon.com, Inc. [retrieved on Nov. 13, 2019]. Retrieved from the Internet: <URL: https://www.amazon.ca/MaxxHaul-70089-Steel-Trailer-Step/dp/B008CE0TNE>.

* cited by examiner

ADJUSTABLE STEP

RELATED APPLICATIONS

Non-applicable.

FIELD OF THE INVENTION

The presently disclosed subject matter is directed to an adjustable step.

BACKGROUND OF THE INVENTION

Recreational boating has earned a well-deserved spot of the list of favorite pastimes of countless people. The ability to get outside and enjoy warm weather, sunshine and water make all kinds of boating truly enjoyable. One skill that must be mastered by all boat users is climbing in and out of the boat, typically from a dock. While easy for many, the vast height difference between the dock surface and the boat, depending on water levels, make transfers difficult.

While intermediate steps would certainly assist, they often prohibit the boat from approaching the dock. Additionally, as water levels vary, permanently installed steps would be at the wrong position as well. Accordingly, there exists a need for a means by transfer in and out of a boat from a dock can be made easier for all in a manner which addresses the above-mentioned concerns. The development of the adjustable step fulfills this need.

SUMMARY OF THE INVENTION

The principles of the present invention provide for an adjustable removable step which comprises a step section which has a top portion. The top portion is covered with a non-slip surface that serves as a stepping point for a person's foot. The adjustable removable step also comprises a clamp section which forms a "C-shaped" structure around a clamping area. The step section and the clamp section are manufactured from a single continuous piece of material. The clamping area is surrounded by the clamp section on three sides of the clamp section. The adjustable removable step also comprises a threaded fastener which secures the clamp section to a support structure. The threaded fastener includes a first washer and a second washer. The adjustable removable step also comprises a threaded hole which is disposed adjacent to the clamp section to receive the threaded fastener.

The non-slip surface is a safety feature of the adjustable removable step that may prevent slips and falls. The step section may be positioned in a perpendicular manner to the support structure and may be secured in place via the clamp section and the threaded fastener. The non-slip surface may be a surface selected from the group consisting of an adhesive coating, one or more directly applied materials, a plurality of embossed grooves, or a plurality of machined grooves. The step section may be five-and-three-quarter inches long. The single continuous piece of material may be a metal selected from the group consisting of galvanized steel, stainless steel, or aluminum alloy or may be aluminum alloy 6061-T6 to provide strength and ease of heat-treatment.

The washers may distribute pressure of the threaded fastener evenly over the support structure, so the support structure isn't damaged. The washers may ensure that the threaded fastener may be pressed against a smooth surface of the washers which reduces the chance that the washers gradually loosen because they are in contact with an uneven surface. The threaded fastener may be a fastener selected from the group consisting of a bolt, a screw, or a cylindrical socket head cap screw while the support structure may be a standard two-inch tube accepted by the clamping area. The support structure may also be a standard two-and-a-half inch tube accepted by the clamping area. The clamp section may be positioned at a fifteen degree angle to a horizontal axis. The adjustable removable step may be slid up and down the support structure along an adjustable removable step travel path for a final resting position at an infinite number of locations. The three sides of the clamp section may surround and receive the support structure within the clamp section. The threaded fastener may be loosened but not removed to allow for repositioning of the step section along the support structure. The threaded fastener may be tightened against the clamp section to secure the adjustable removable step once the step section is repositioned. The second washer may be made of neoprene to enable vertical adjustment of the step section along the support structure without having to remove the threaded fastener. The adjustable removable step may hold up to three hundred and fifty pounds. The adjustable removable step may be ten inches long and three-and-a-half inches wide.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
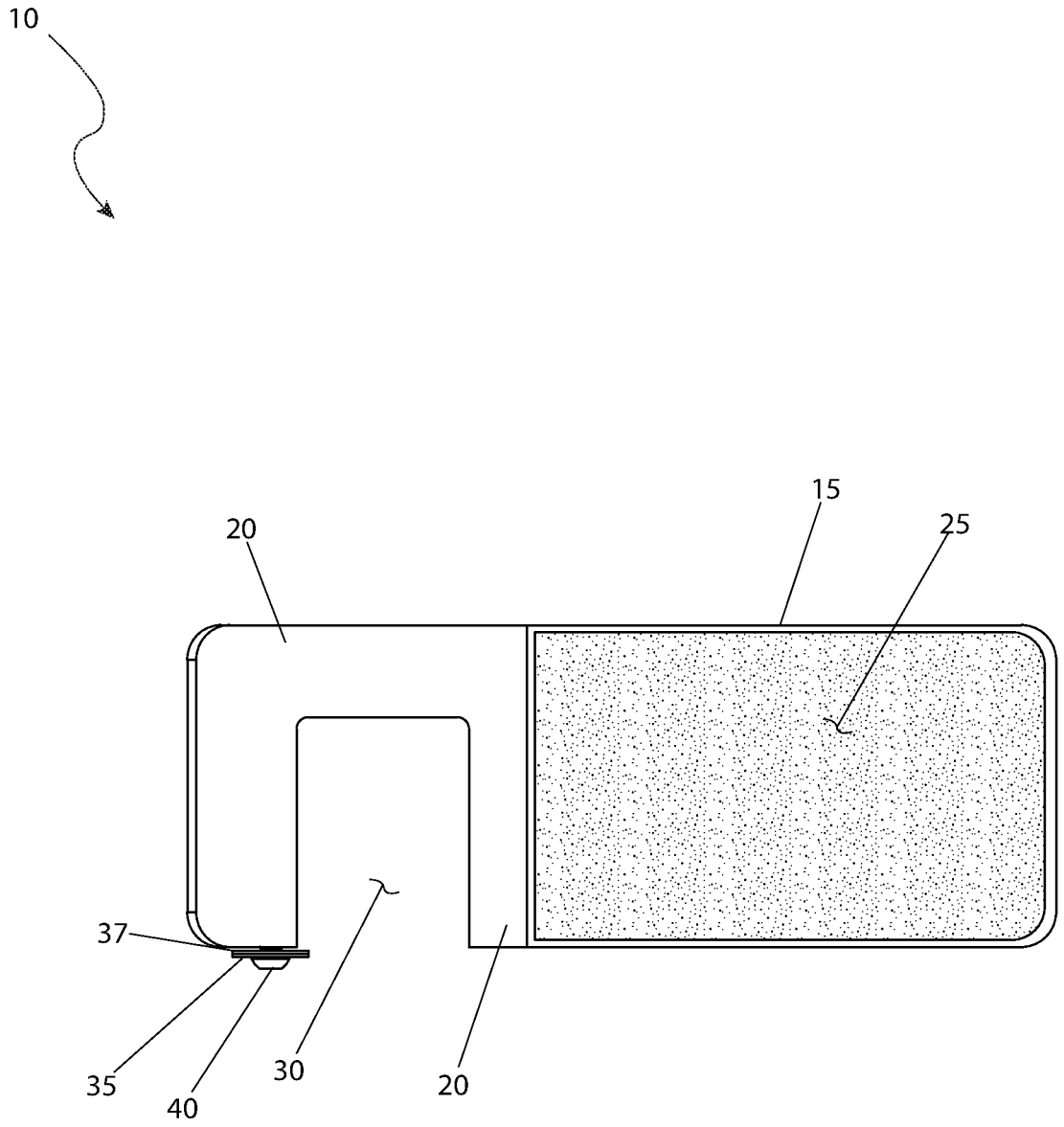
FIG. 1 is a top view of the adjustable removable step 10, according to the preferred embodiment of the present invention.

10 adjustable removable step
15 step section
20 clamp section
25 non-slip surface
30 clamping area
35 first washer
37 second washer
40 threaded fastener
45 threaded hole
50 angle "a"
55 support structure
60 90-degree (90°) angle "b"
65 step travel path "s"

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a top view of the adjustable removable step 10, according to the preferred embodiment of the present invention is disclosed. The adjustable removable step 10 (herein also described as the "step") 10, is an attachable and adjustable step, particularly suited for removable attachment to a boat dock or similar vertical structures. The step 10 includes a step section 15 and a clamp section 20. Both the step section 15 and the clamp section 20 are envisioned to manufactured from one (1) continuous piece of metal such as aluminum alloy 6061-T6. However, the step 10 may be made from other equivalent metal such as galvanized steel, stainless steel, other grades of aluminum, or the like, and as such, the materials of construction are not envisioned to be a limiting factor of the present invention.

The top portion of the step section 15 is covered with a non-slip surface 25 such as, but not limited to: an adhesive coating, directly applied materials, embossing or machined grooves directly in the step section 15 or the like. As the area occupied by the non-slip surface 25 serves as a stepping point for a user's foot in a water-based environment and likely to be slippery, the non-slip surface 25 is a safety feature of the step 10 by preventing slips and falls.

The clamp section 20 form a "C"-like structure around a clamping area 30. The clamping area 30 will be described in greater detail herein below. Securement of the clamp section 20 is provided by a first washer 35, a second washer 37, and a threaded fastener 40. The threaded fastener 40 is envisioned to be a cylindrical socket head cap screw (as shown). However, other types of fasteners such as bolts, screws, and the like may also be used with equal success. As such, the exact type of threaded fastener 40 is not intended to be a limiting factor of the present invention. The step 10 is envisioned to be used upon and supported by standard two-inch (2 in.) or two-and-a-half (2½ in.) tube commonly used to make boat docks and would subsequently be accepted by the clamping area 30. However, those skilled in the art will realize that all dimensions of the step 10 can be readily modified to allow the step 10 to easily be mounted on a wide variety of suitable structures. All dimensions are scalable, both proportionally and individually, to suit the need at hand. Approximate nominal dimensions of a typical step 10 are envisioned to be ten inches (10 in.) long and three-and-a-half inches (3½ in.) wide. The step section 15 would be approximately five-and-three-quarter inches (5¾ in.).

Figure 2:
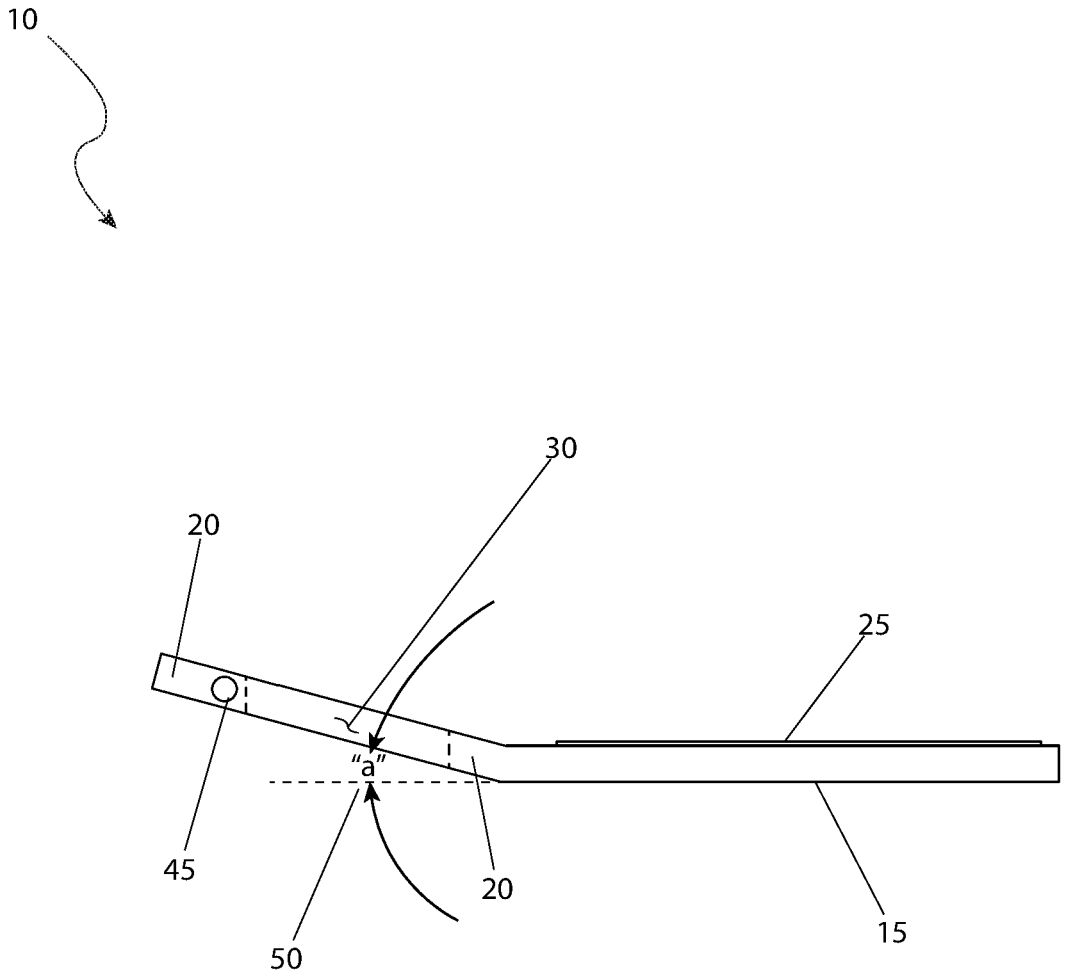
FIG. 2 is a side view of the adjustable removable step 10, according to the preferred embodiment of the present invention.

Referring next to FIG. 2, a side view of the step 10, according to the preferred embodiment of the present invention is depicted. In this figure, the first washer 35, second washer 37, and the threaded fastener 40 (as shown in FIG. 1) are not shown for purposes of clarity. The non-slip surface 25 is shown atop the step section 15. The clamping area 30 is surrounded by the clamp section 20 on three (3) sides. A threaded hole 45 is provided in the distal surface of the clamp section 20 for acceptance of the threaded fastener 40 as aforementioned described. The clamp section 20 is positioned at an angle "a" 50 envisioned to be approximately fifteen degrees (15°).

Figure 3:
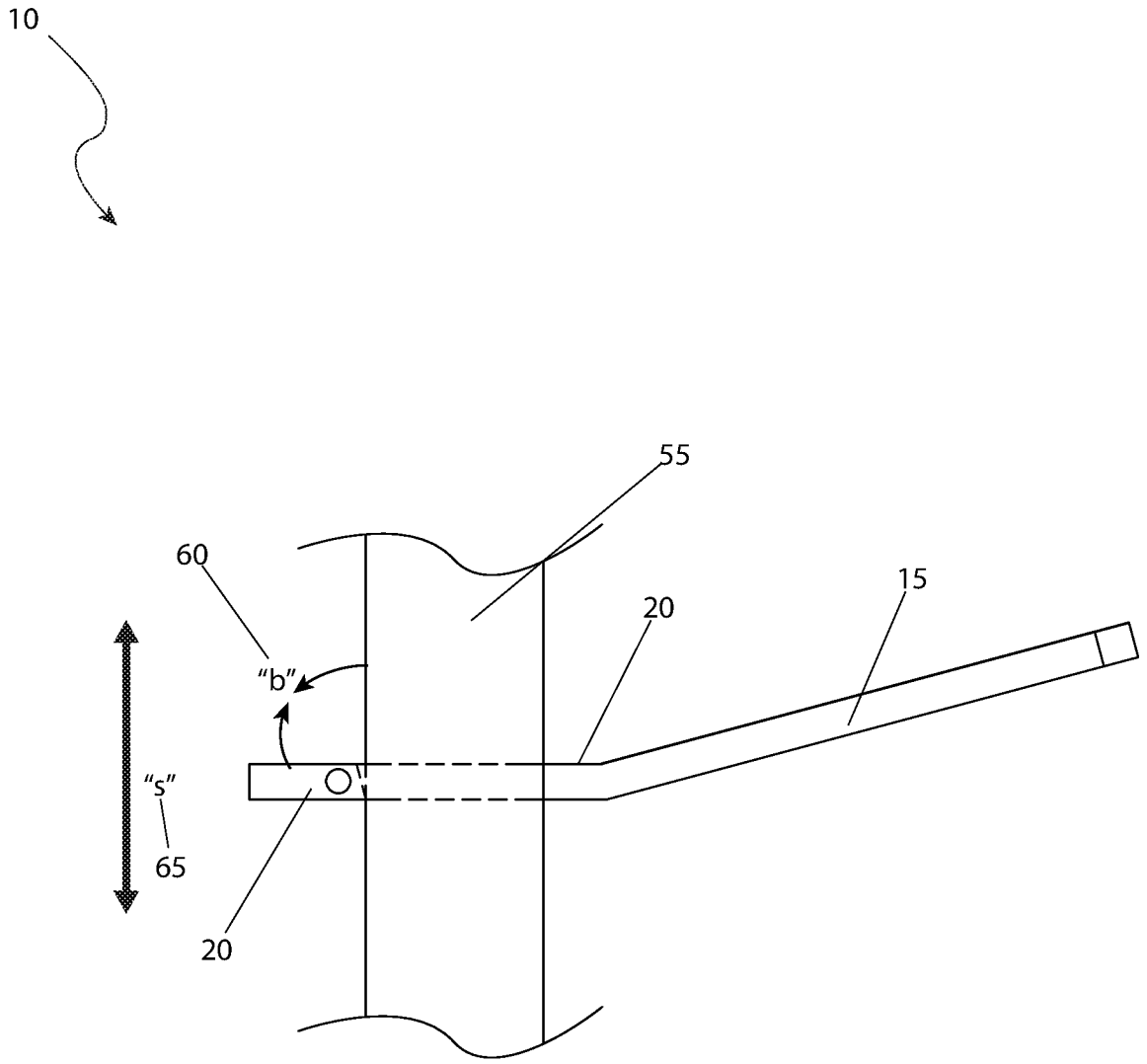
FIG. 3 is a side view of the adjustable removable step 10, shown in a state of being installed, according to the preferred embodiment of the present invention.

Referring now to FIG. 3, a side view of the step 10, shown in a state of being installed, according to the preferred embodiment of the present invention is shown. During installation of the step 10 upon a support structure 55. The clamp section 20 is placed at a 90-degree (90°) angle "b" 60, with the three (3) sides of the clamp section 20 is mechanical communication with the 90-degree (90°) angle "b" 60. It is noted that the threaded hole 45 is visible and the first washer 35 and the threaded fastener 40 (both of which are shown in FIG. 1) are removed. This placement orientation places the non-slip surface 25 at a fifteen degree (15°) upward angle During such a configuration, the step 10 may be slid up and down the support structure 55 along a step travel path "s" 65 for a final resting position at any one of an infinite number of locations.

Figure 4:
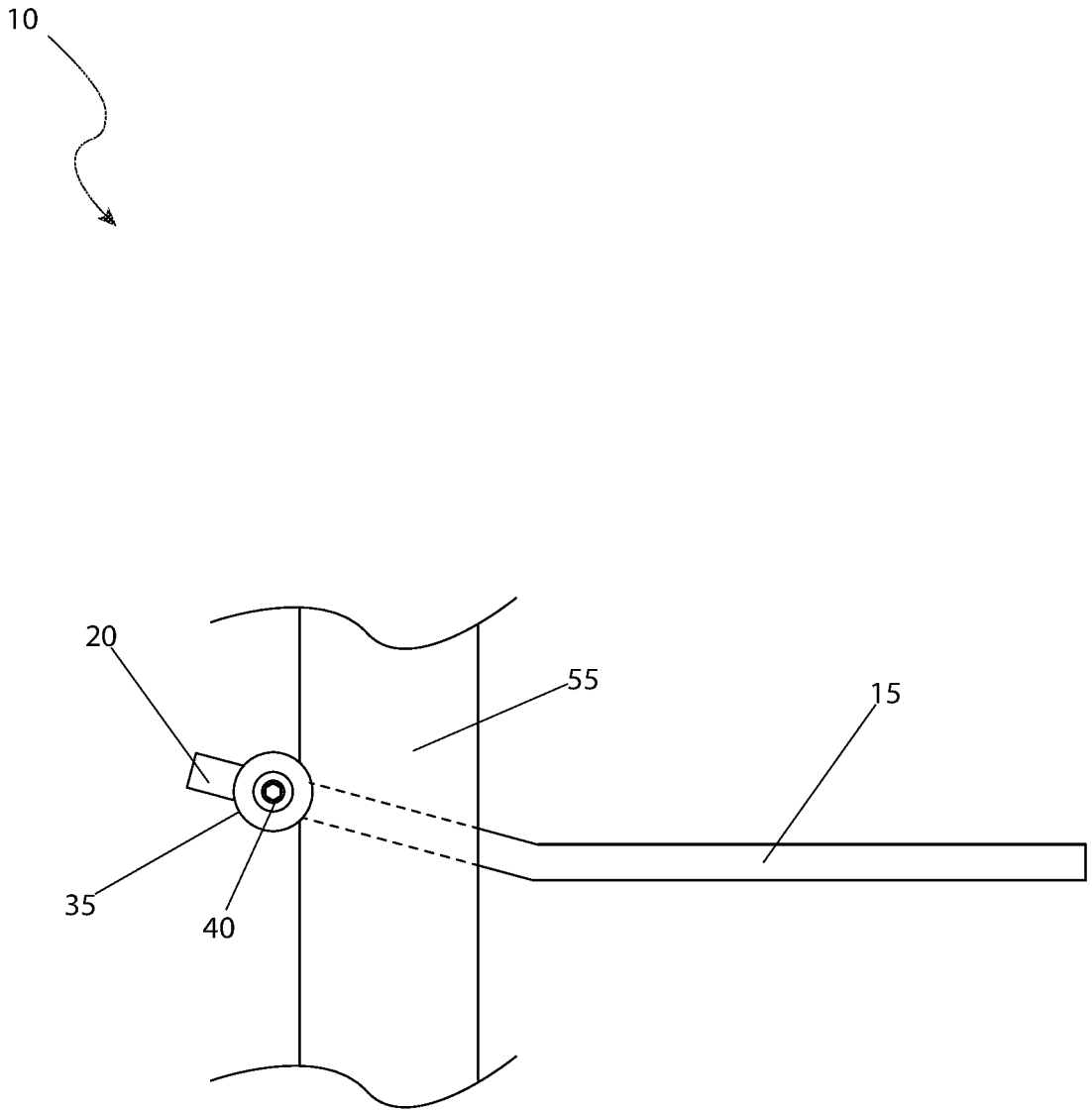
FIG. 4 is a side view of the adjustable removable step 10, shown in an installed state, according to the preferred embodiment of the present invention; and, FIG. 5 is a perspective view of the adjustable removable step 10, shown in an installed state, according to the preferred embodiment of the present invention.

Referring next to FIG. 4, a side view of the step 10, shown in an installed state, according to the preferred embodiment of the present invention is disclosed. The step section 15 of the step 10 is angled downward along a fifteen degree (15°) with respect to the clamp section 20. The step 10 is then secured to the support structure 55 with the use of the oversize washer 35 and the threaded fastener 40 that is placed into the threaded hole 45 (as shown in FIG. 2). At this point in time, the step 10 is ready for utilization.

Figure 5:
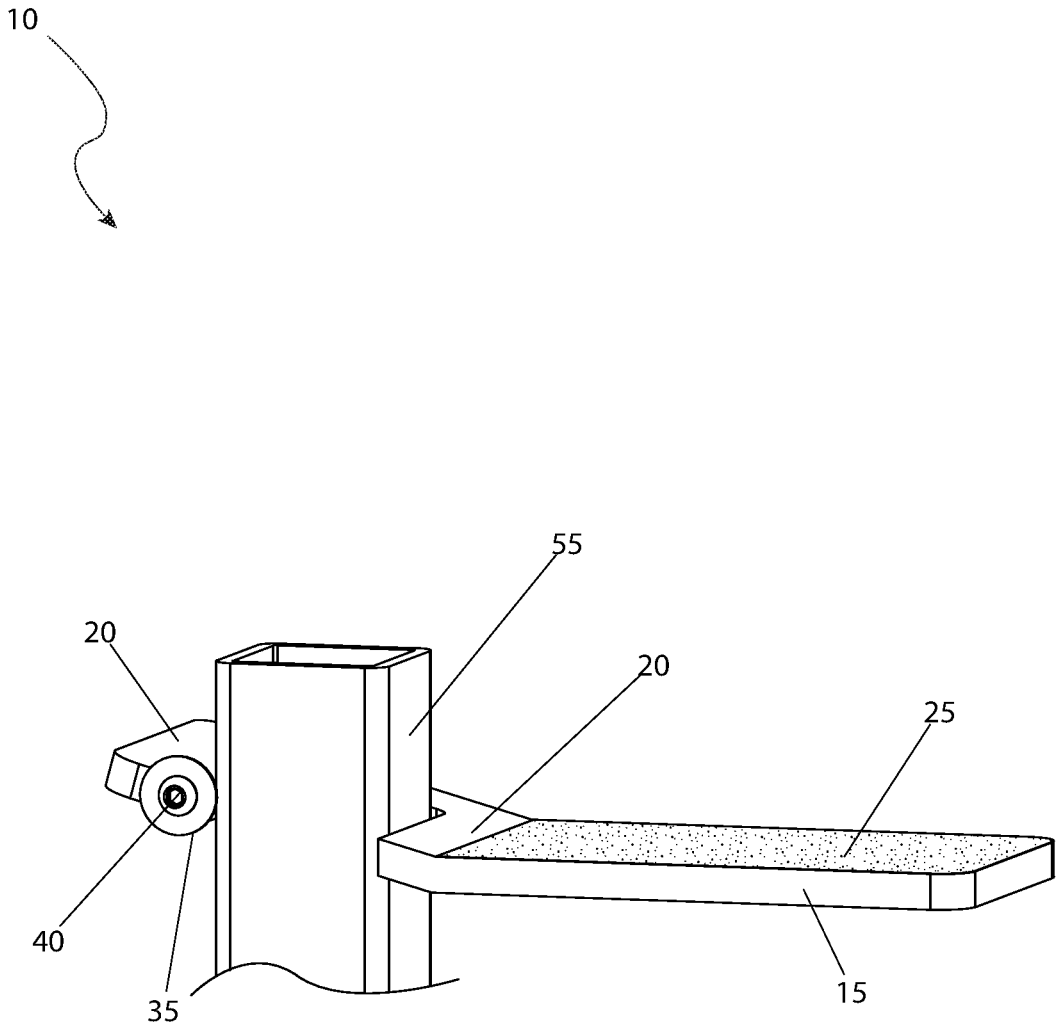

Referring to FIG. 5, a perspective view of the step 10, shown in an installed state, according to the preferred embodiment of the present invention is depicted. This view more clearly shows the position of the step 10 upon the support structure 55. The step section 15 with its non-slip surface 25 is positioned in a perpendicular manner to the support structure 55 and is secured in place via the clamp section 20 and the restraining first washer 35, second washer 37 and threaded fastener 40. It is envisioned that the first washer 35, second washer 37, and threaded fastener 40 may be loosened but not removed, to allow for repositioning of the step section 15 along the support structure 55 in general motion along the step travel path "s" 65 (as shown in FIG. 3). Once repositioned, the threaded fastener 40 may be tightened against the first washer 35, second washer 37, and the clamp section 20 to secure the step 10. Preferably, however, the threaded fastener 40 secures the first washer 35 and second washer 37 permanently to the clamp section 20. The material of the second washer 37, envisioned to be neoprene or other similar material, enables vertical adjustment of the step section 15 along the support structure 55 without having to remove the threaded fastener 40.

While specifically envisioned for use on boat docks made of tubular steel, the step 10 may be used on any similar structure in which climbing access is required. The repositionable nature of the step 10, makes it ideal for use in locations where water levels change and the need for steps in varying positions are important. The materials and corresponding design of the step 10 are envisioned to hold up to three hundred and fifty pounds (350 lbs.).

2. OPERATION OF THE PREFERRED EMBODIMENT

The preferred embodiment of the present invention can be utilized by the common user in a simple and effortless manner with little or no training. It is envisioned that the step 10 would be constructed in general accordance with FIG. 1 through FIG. 5. The user would procure the step 10 from conventional procurement channels such as boating supply stores, mechanical supply houses, hardware stores, home improvement stores, mail order and internet supply houses and the like. Special attention would be paid to the overall materials of construction, type or method of non-slip surface 25, overall dimensions of the clamping area 30, type and size of support structure 55 upon which the step 10 is to be used, and other factors.

After procurement and prior to utilization, the step 10 would be prepared in the following manner: the first washer 35, second washer 37, and the threaded fastener 40 would be removed from the threaded hole 45 on the clamp section 20; the clamping area 30 would then be placed around a support structure 55 with the clamp section 20 and a 90-degree (90°) angle "b" 60; the exact position of the step section 15 with relation to the height of the support structure 55 would be finalized; the step section 15 of the step 10 would be lowered such that the step section 15 is now perpendicular to the support structure 55 and the clamp section 20 is at a fifteen degree (15°) angle to the support structure 55; the first washer 35 and second washer 37 would be placed on the threaded fastener 40; the threaded fastener 40 would then be inserted into the threaded hole 45; and the threaded fastener 40 tightened to secure the step 10 into position.

During utilization of the step 10, the following procedure would be initiated: the user would step upon the non-slip surface 25 of the step section 15 to climb up or down the support structure 55 such as when entering or exiting a boat.

After use of the step 10, the step section 15 may be left in position, removed, or readjusted by loosening of the threaded fastener 40; moving it up or down the support structure 55 and then retightening the threaded fastener 40, or more preferably, by vertical adjustment of the step section 15 due to the material and presence of the second washer 37.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An adjustable removable step, comprising:

a step section having a top portion, the top portion is covered with a non-slip surface that serves as a stepping point for a person's foot;

a clamp section forming a "C-shaped" structure around a clamping area, the step section and the clamp section are manufactured from a single continuous piece of material, the clamping area is surrounded by the clamp section on three sides of the clamp section;

a threaded fastener securing the clamp section to a support structure, the threaded fastener includes a first washer and a second washer; and a threaded hole disposed adjacent to the clamp section to receive the threaded fastener.

2. The adjustable removable step according to claim 1, wherein the non-slip surface is a safety feature of the adjustable removable step that prevents slips and falls.

3. The adjustable removable step according to claim 1, wherein the step section is positioned in a perpendicular manner to the support structure and is secured in place via the clamp section and the threaded fastener.

4. The adjustable removable step according to claim 1, wherein the non-slip surface is a surface selected from the group consisting of an adhesive coating, one or more directly applied materials, a plurality of embossed grooves, or a plurality of machined grooves.

5. The adjustable removable step according to claim 1, wherein the step section is five-and-three-quarter inches long.

6. The adjustable removable step according to claim 1, wherein the single continuous piece of material is a metal selected from the group consisting of galvanized steel, stainless steel, or aluminum alloy.

7. The adjustable removable step according to claim 1, wherein the single continuous piece of material is aluminum alloy 6061-T6 to provide strength and ease of heat-treatment.

8. The adjustable removable step according to claim 1, wherein the washers distribute pressure of the threaded fastener evenly over the support structure so the support structure isn't damaged.

9. The adjustable removable step according to claim 1, wherein the washers ensure that the threaded fastener is pressed against a smooth surface of the washers reducing the chance that the washers gradually loosen because they are in contact with an uneven surface.

10. The adjustable removable step according to claim 1, wherein the threaded fastener is a fastener selected from the group consisting of a bolt, a screw, or a cylindrical socket head cap screw.

11. The adjustable removable step according to claim 1, wherein the support structure is a standard two-inch tube accepted by the clamping area.

12. The adjustable removable step according to claim 1, wherein the support structure is a standard two-and-a-half inch tube accepted by the clamping area.

13. The adjustable removable step according to claim 1, wherein the clamp section is positioned at a fifteen degree angle to a horizontal axis.

14. The adjustable removable step according to claim 13, wherein the adjustable removable step is slid up and down the support structure along an adjustable removable step travel path for a final resting position at an infinite number of locations.

15. The adjustable removable step according to claim 1, wherein the three sides of the clamp section surround and receive the support structure within the clamp section.

16. The adjustable removable step according to claim 1, wherein the threaded fastener is loosened but not removed to allow for repositioning of the step section along the support structure.

17. The adjustable removable step according to claim 16, wherein the threaded fastener is tightened against the clamp section to secure the adjustable removable step once the step section is repositioned.

18. The adjustable removable step according to claim 1, wherein the second washer is made of neoprene to enable vertical adjustment of the step section along the support structure without having to remove the threaded fastener.

19. The adjustable removable step according to claim 1, wherein the adjustable removable step holds up to three hundred and fifty pounds.

20. The adjustable removable step according to claim 1, wherein the adjustable removable step is ten inches long and three-and-a-half inches wide.

* * * * *